US009761145B2

(12) United States Patent
Ejiri

(10) Patent No.: US 9,761,145 B2
(45) Date of Patent: Sep. 12, 2017

(54) VEHICLE INFORMATION PROJECTION SYSTEM

(71) Applicant: NIPPON SEIKI CO., LTD., Niigata (JP)

(72) Inventor: Takeshi Ejiri, Niigata (JP)

(73) Assignee: NIPPON SEIKI CO., LTD., Niigata (JP)

( * ) Notice: Subject to any disclaimer, the term of this patent is extended or adjusted under 35 U.S.C. 154(b) by 0 days.

(21) Appl. No.: 15/034,801

(22) PCT Filed: Nov. 11, 2014

(86) PCT No.: PCT/JP2014/079781

§ 371 (c)(1),
(2) Date: May 5, 2016

(87) PCT Pub. No.: WO2015/076142

PCT Pub. Date: May 28, 2015

(65) Prior Publication Data

US 2016/0284218 A1 Sep. 29, 2016

(30) Foreign Application Priority Data

Nov. 19, 2013 (JP) ..... 2013-238648

(51) Int. Cl.
*G08G 1/16* (2006.01)

(52) U.S. Cl.
CPC ..... *G08G 1/167* (2013.01); *G08G 1/166* (2013.01)

(58) Field of Classification Search
CPC ..... G01S 13/931; G01S 2013/9325; G01S 2013/9332; G08G 1/16; G08G 1/166; G08G 1/167; G08G 1/065; G08G 1/068
See application file for complete search history.

(56) References Cited

U.S. PATENT DOCUMENTS 6,559,761 B1 * 5/2003 Miller ..... B60R 1/00 340/435
7,755,508 B2 * 7/2010 Watanabe ..... B60Q 1/2665 180/167

(Continued)

FOREIGN PATENT DOCUMENTS

JP H10-75479 A 3/1998
JP 2000-194995 A 7/2000

(Continued)

OTHER PUBLICATIONS

Search Report issued in corresponding International Application No. PCT/JP2014/079781, dated Feb. 3, 2015.

*Primary Examiner* — Van Trieu
(74) *Attorney, Agent, or Firm* — McDermott Will & Emery LLP

(57) ABSTRACT

Provided is a vehicle information projection system capable of accurately determining the approaching state of an obstacle and assisting the driver in driving. A vehicle information projection system that enables a user to view an image showing a lane information image together with the actual view outside a host vehicle, wherein a rearward-information acquisition unit detects the approaching of a rearward vehicle as well as the relative distance and the relative speed between the host vehicle and the rearward vehicle, and when the approaching of the rearward vehicle is detected by the rearward-information acquisition unit, a display controller performs display control so as to superpose and make visible a trajectory image that indicates the approaching of the rearward vehicle in a lane adjacent to that on which the host vehicle is traveling as acquired by a lane-information acquisition means.

3 Claims, 7 Drawing Sheets

(56) References Cited

U.S. PATENT DOCUMENTS

| | | | | |
|---|---|---|---|---|
| 8,666,662 | B2 * | 3/2014 | Irie | G01C 21/3658 340/995.1 |
| 2005/0273263 | A1 * | 12/2005 | Egami | G08G 1/163 701/301 |
| 2011/0293145 | A1 * | 12/2011 | Nogami | B60R 1/00 382/103 |
| 2012/0296522 | A1 * | 11/2012 | Otuka | G08G 1/167 701/41 |
| 2013/0050491 | A1 * | 2/2013 | Lin | G08G 1/0962 348/148 |

FOREIGN PATENT DOCUMENTS

| | | | |
|---|---|---|---|
| JP | 2007-034684 | A | 2/2007 |
| JP | 2008-015758 | A | 1/2008 |

* cited by examiner

【FIG.1】
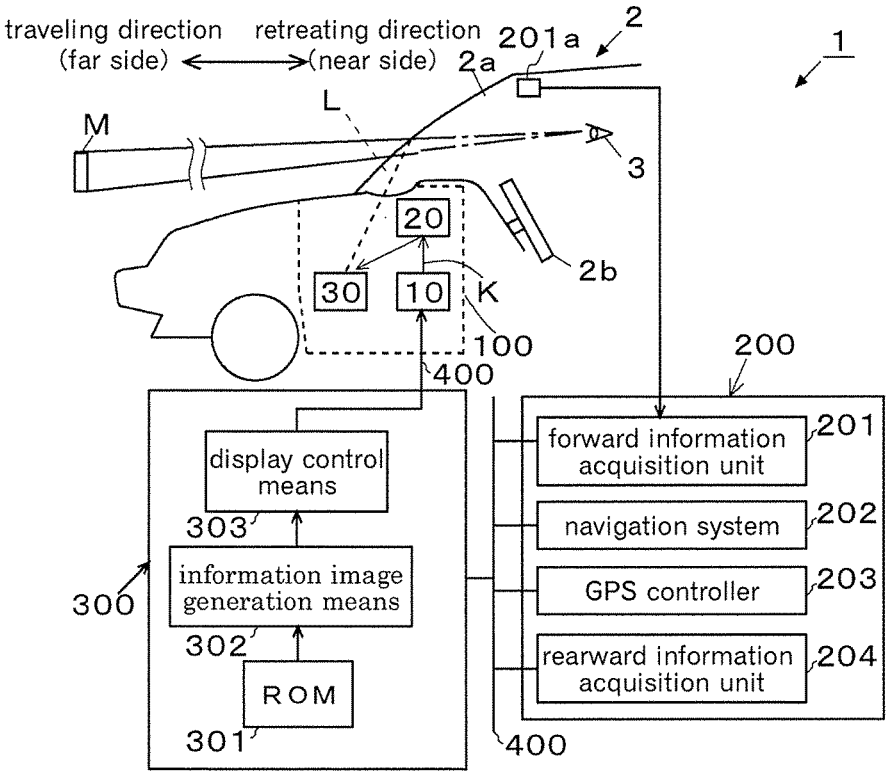
【FIG.2】
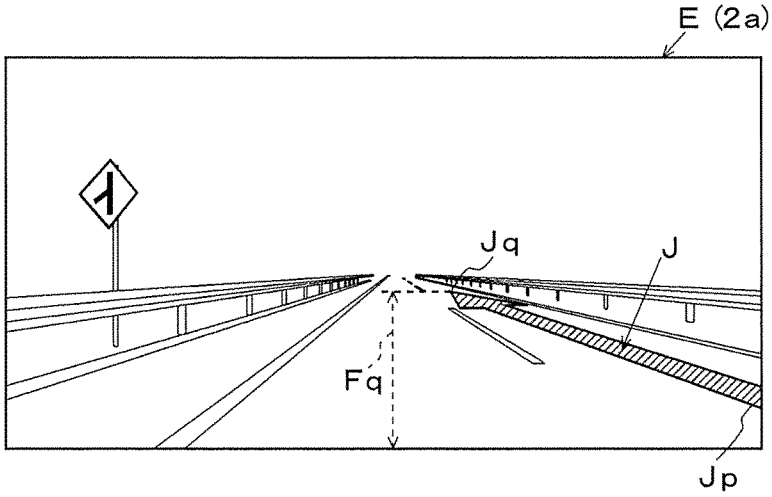

【FIG.3】
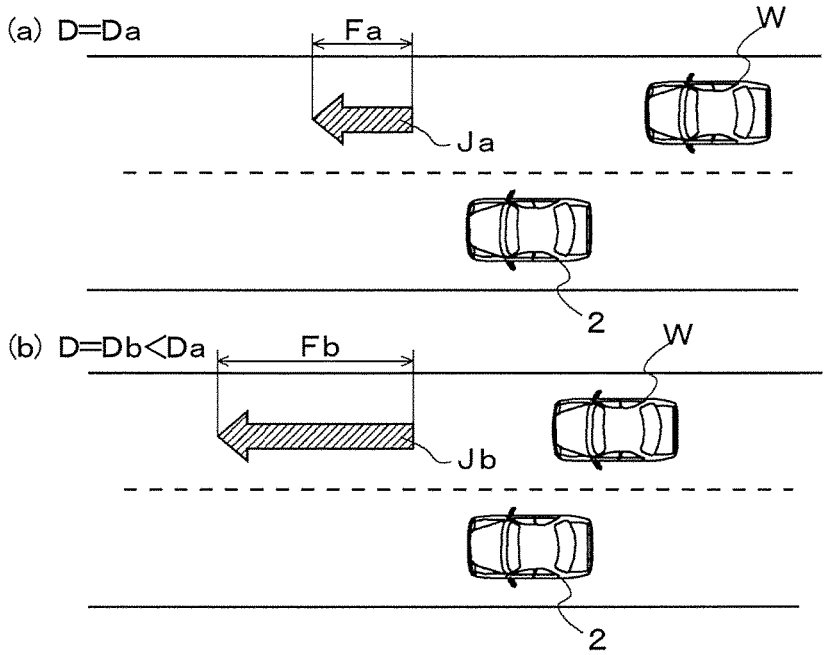
【FIG.4】
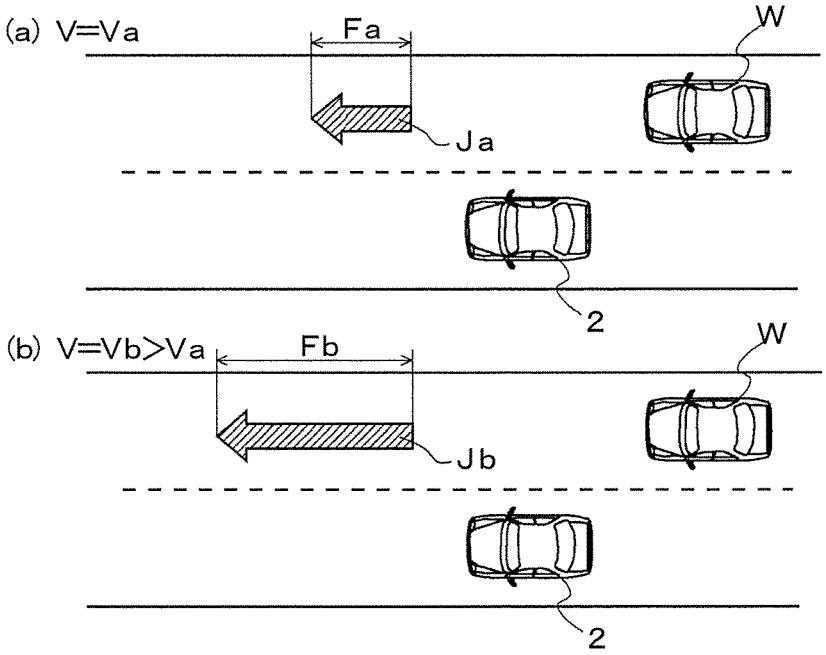

【FIG.5】
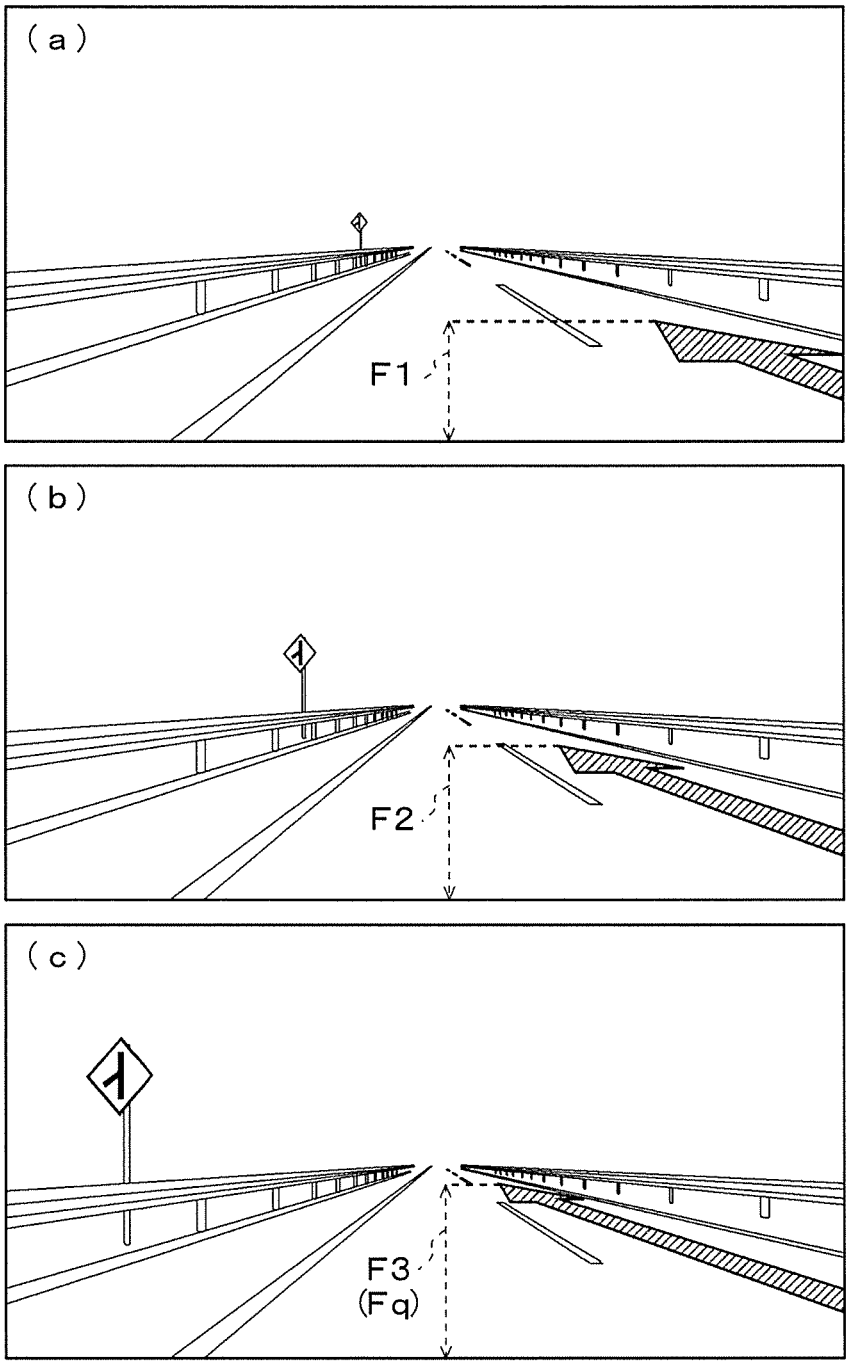

【FIG.6】

| | | RELATIVE SPEED V | | |
|---|---|---|---|---|
| | | LOW SPEED | MIDDLE SPEED | HIGH SPEED |
| RELATIVE DISTANCE D | LONG DISTANCE | EXTENSION SPEED $\gamma$ (DEFORMATION SPEED $\gamma$) | EXTENSION SPEED $\gamma$ (DEFORMATION SPEED $\gamma$) | EXTENSION SPEED $\beta$ (DEFORMATION SPEED $\beta$) |
| | MIDDLE DISTANCE | EXTENSION SPEED $\gamma$ (DEFORMATION SPEED $\gamma$) | EXTENSION SPEED $\beta$ (DEFORMATION SPEED $\beta$) | EXTENSION SPEED $\alpha$ (DEFORMATION SPEED $\alpha$) |
| | SHORT DISTANCE | EXTENSION SPEED $\beta$ (DEFORMATION SPEED $\beta$) | EXTENSION SPEED $\alpha$ (DEFORMATION SPEED $\alpha$) | EXTENSION SPEED $\alpha$ (DEFORMATION SPEED $\alpha$) |

EXTENSION SPEED $\alpha > \beta > \gamma$
DEFORMATION SPEED $\alpha > \beta > \gamma$

【FIG.7】

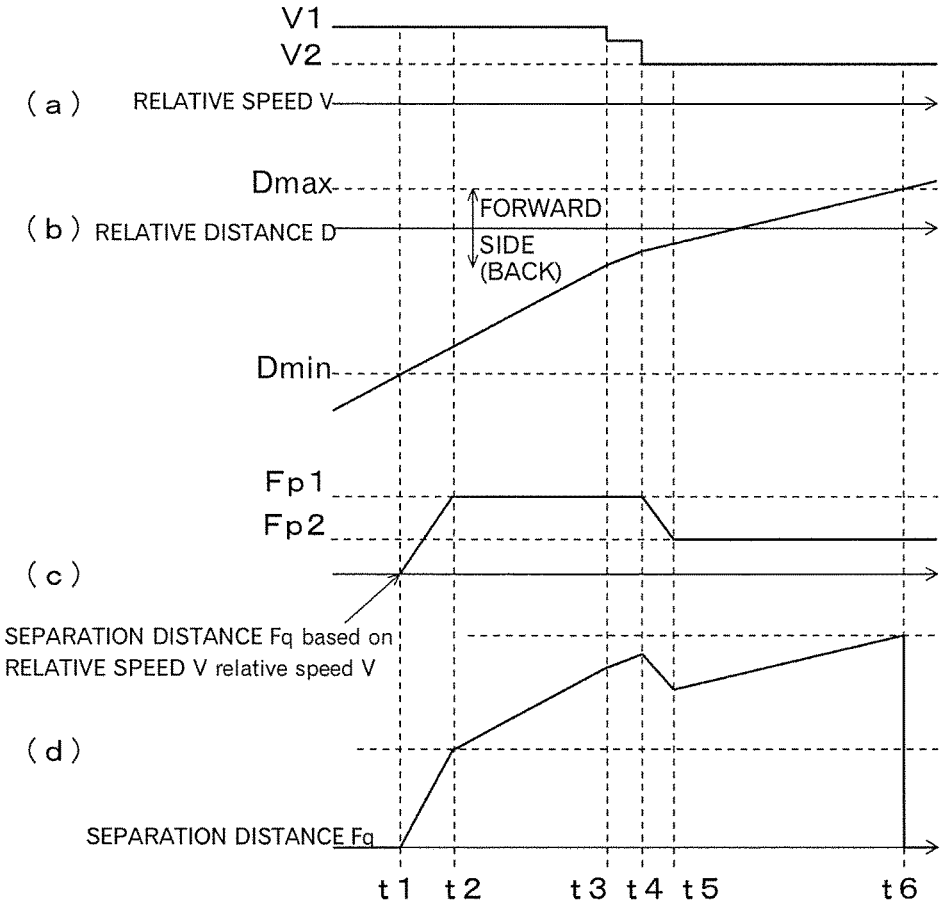

【FIG.8】
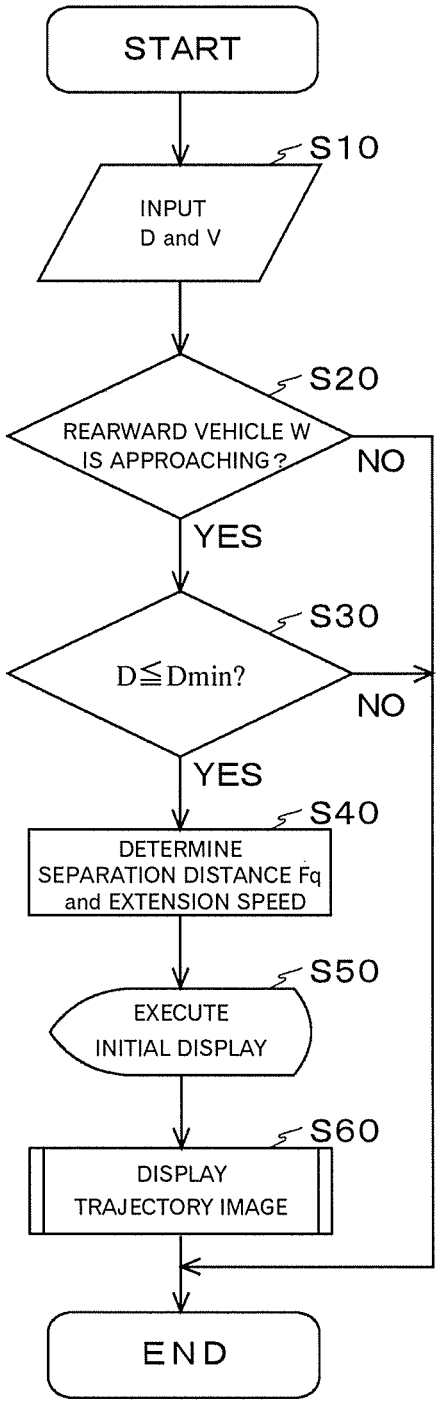

【FIG.9】
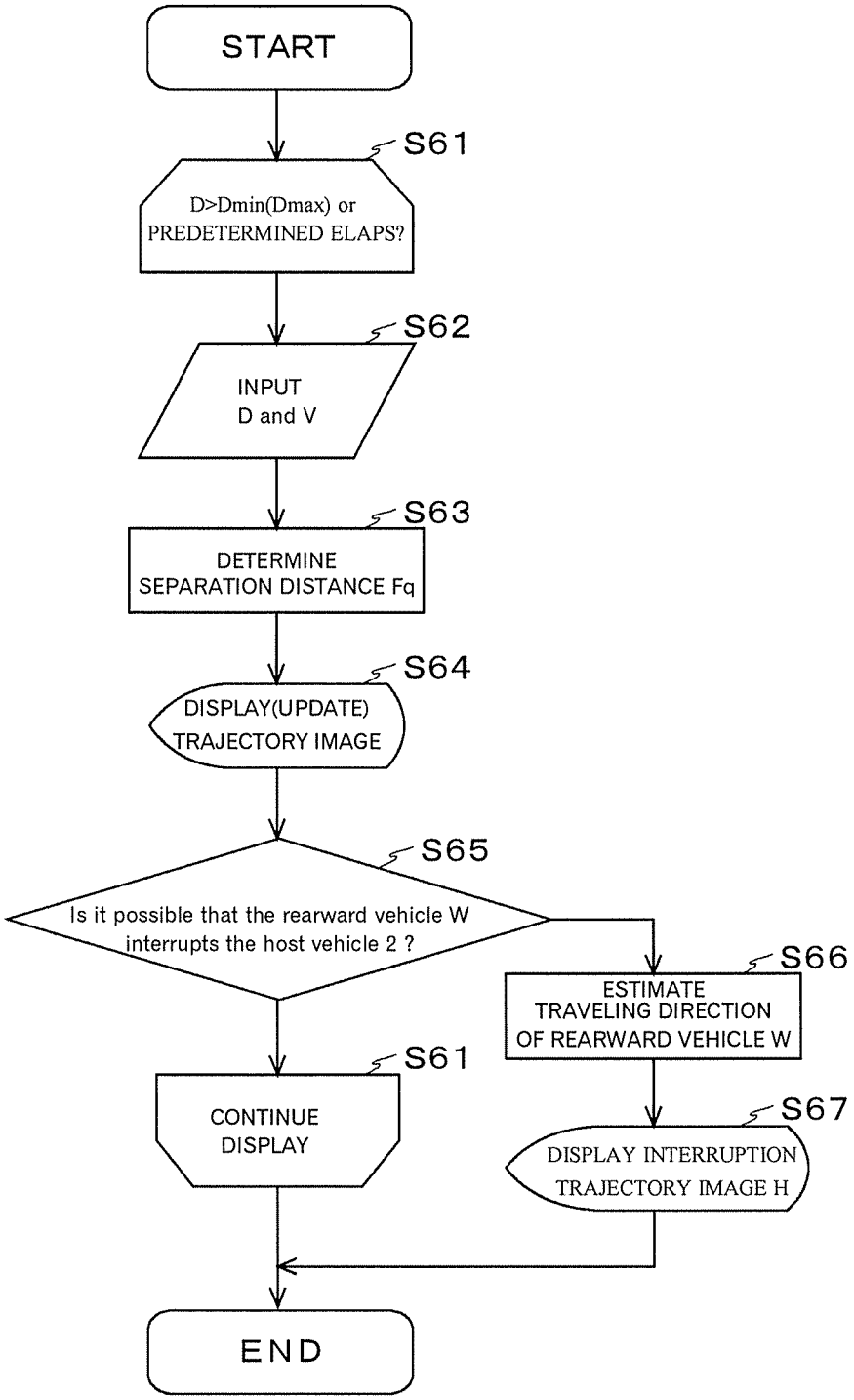

【FIG.10】
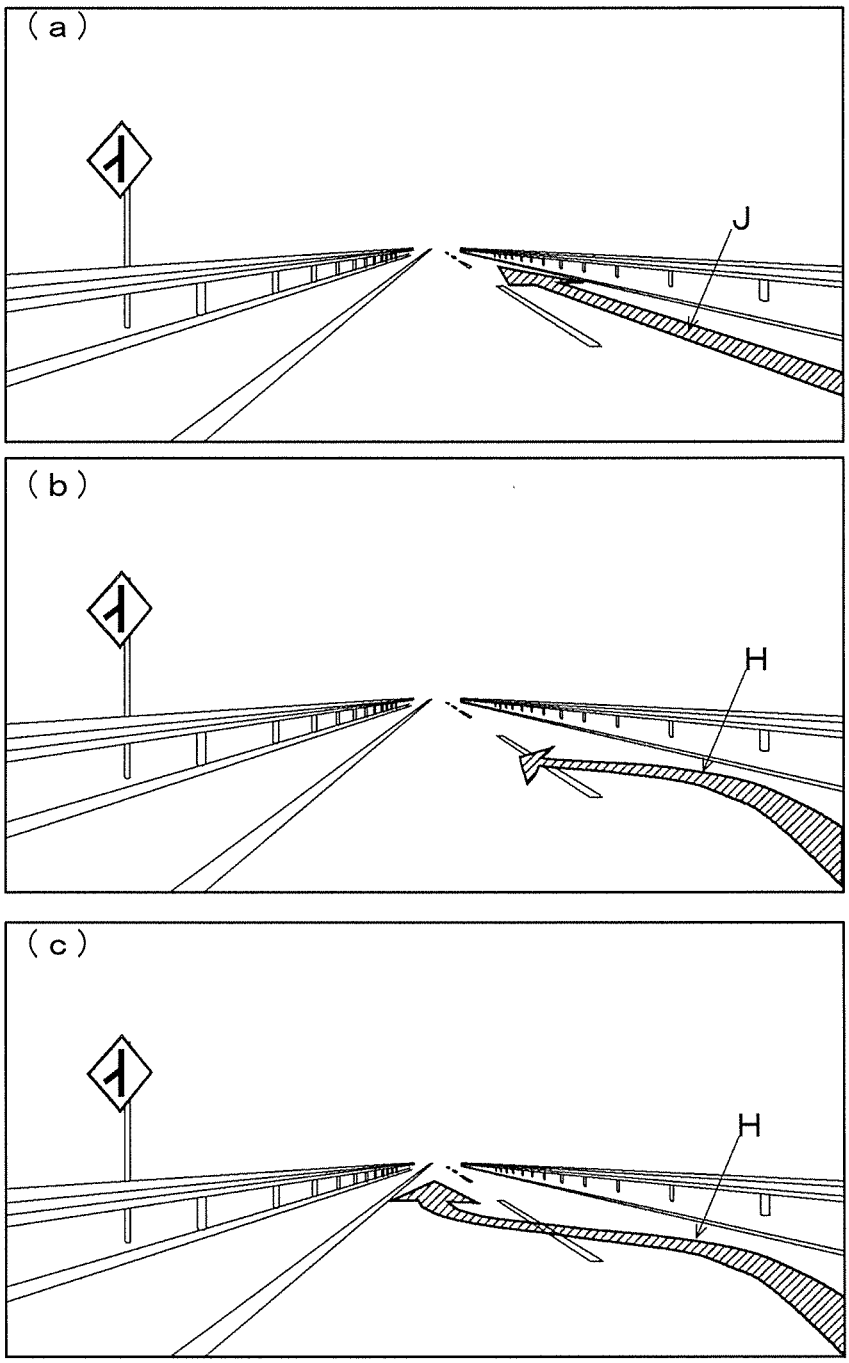

VEHICLE INFORMATION PROJECTION SYSTEM

CROSS REFERENCE

This application is the U.S. National Phase under 35 US.C. §371 of International Application No. PCT/JP2014/079781, filed on Nov. 11, 2014, which claims the benefits of Japanese Application No. 2013-238648, filed on Nov. 19, 2013,the entire contents of each are hereby incorporated by reference.

TECHNICAL FIELD

The present invention relates to a vehicle information projection system which warns a user about an obstacle approaching a host vehicle.

BACKGROUND ART

As a conventional vehicle information projection system which warns a user about an obstacle approaching a host vehicle, a head-up display (HUD) device as disclosed in Patent Literature 1 is known. Such a HUD device displays a relative distance between the host vehicle and a rearward vehicle (the obstacle) located on the rear of the host vehicle as a virtual image, whereby a user can view the existence of the rearward vehicle approaching the rear of the host vehicle and the relative distance together with outside scenery in front thereof.

CITATION LIST

Patent Literature

Patent Literature 1: JP-A-2000-194995

SUMMARY OF THE INVENTION

Problems to be Solved by the Invention

However, as an image displayed on the HUD device in Patent Literature 1, only the relative distance between the host vehicle and the rearward vehicle (an overtaking vehicle) approaching from the rear (a dead space) of the host vehicle is displayed. Therefore, the user is not able to intuitively know at which speed and in which direction the rearward vehicle is approaching, and is not able to determine what kind of action to take next at which timing.

The present invention is proposed in consideration of these problems, and an object thereof is to provide a vehicle information projection system capable of accurately determining an approaching state of an obstacle and assisting a driver in driving.

Means for Solving the Problem

To achieve the above object, a vehicle information projection system according to present invention which is provided with a projection device projecting an information image, and a lane-information acquisition means acquiring lane information, and makes a user view an image showing the information image with an actual view outside a host vehicle, the system comprising: a rearward vehicle detection means configured to detect a relative distance and a relative speed between the host vehicle and the rearward vehicle; and a display controller configured to control the projection device so as to superpose and make visible an approach-indicating image which indicates approaching of the rearward vehicle in a lane adjacent to that on which the host vehicle is traveling when approaching of the rearward vehicle is detected by the rearward vehicle detection means.

Effect of the Invention

According to the present invention, a vehicle information projection system capable of accurately determining an approaching state of an obstacle and assisting a driver in driving can be provided.

BRIEF DESCRIPTION OF THE DRAWINGS

FIG. 1 is a diagram illustrating a configuration of a vehicle information projection system in an embodiment of the present invention.

FIG. 2 is a diagram illustrating scenery which a vehicle occupant in the above-described embodiment views.

FIG. 3 is a diagram illustrating a change in a separation distance by a relative distance in the above-described embodiment.

FIG. 4 is a diagram illustrating a change in the separation distance by the relative speed in the above-described embodiment.

FIG. 5 is a diagram illustrating a transition in a trajectory image in the above-described embodiment.

FIG. 6 is a diagram illustrating table data of the relative distance and the relative speed in the above-described embodiment.

FIG. 7 is a timing chart illustrating a transition in the trajectory image in the above-described embodiment.

FIG. 8 is a flow diagram illustrating an operation process in the above-described embodiment.

FIG. 9 is a flow diagram illustrating a display process of the trajectory image in the above-described embodiment.

FIG. 10 is a diagram illustrating a change transition to an interruption trajectory image from the trajectory image in the above-described embodiment.

MODE FOR CARRYING OUT THE INVENTION

A system configuration of a vehicle information projection system 1 according to the present embodiment is illustrated in FIG. 1. The vehicle information projection system 1 according to the present embodiment consists of a head-up display device (hereinafter, "HUD device") 100 which projects display light L indicating a virtual image M on a windshield 2*a* of a host vehicle 2 and makes an occupant (a user) 3 of the host vehicle 2 view the virtual image M, a vehicle outside information acquisition unit 200 which acquires, for example, a vehicle outside condition on the periphery of the host vehicle 2, and a display controller 300 which controls display of the HUD device 100 based on information input from the vehicle outside information acquisition unit 200.

The HUD device (a projection device) 100 is provided with a display device 10 which displays an information image including a trajectory image J (an approach-indicating image) which is a feature of the present invention on a display surface, a flat mirror 20 which reflects image light K indicating the information image, and a free curved surface mirror 30 which magnifies and transforms the image light K reflected by the flat mirror 20, and reflects the image light K toward the windshield 2*a* as the display light L.

The display device 10 displays the trajectory image J which is an image showing approaching of a rearward vehicle W, a vehicle information image showing information about the host vehicle 2, a navigation information image showing guide routes, and the like, on the display surface under the control the later-described display controller 300. For example, the display device 10 is a transmissive liquid crystal display consisting of a display element (not illustrated), such as a liquid crystal panel, and a light source (not illustrated) which illuminates the display element. Instead of the transmissive liquid crystal display, the display device 10 may be configured by a light emitting organic EL display, a reflective DMD (Digital Micromirror Device) display, a reflective or transmissive LCOS (registered trademark: Liquid Crystal On Silicon) display, and the like. The later-described display controller 300 adjusts a display position of the information image displayed on the display surface of the display device 10 such that an occupant 3 views the information image aligned with a specific object in the scenery outside the host vehicle 2. Therefore, the occupant 3 can view the virtual image M aligned with the specific object in the scenery outside the host vehicle 2.

The flat mirror 20 reflects the image light K, emitted by the display device 10, toward the free curved surface mirror 30.

The free curved surface mirror 30 is configured by forming a reflection film on a surface of a concave base made of a synthetic resin material by, for example, vapor deposition or other means. The free curved surface mirror 30 magnifies the display image (the image light K) reflected on the flat mirror 20, and deforms the display image (the image light K) to emit the same toward the windshield 2*a* as the display light L.

The foregoing is the configuration of the HUD device 100 in the present embodiment, in which the display light L emitted from the HUD device 100 is projected on the windshield 2*a* of the host vehicle 2, whereby the virtual image M is made to be viewed in a predetermined displayable area E of the windshield 2*a* above a steering 2*b*. The displayable area E of the windshield 2*a* corresponds to the display area of the display device 10 and, by moving the information image within the display area of the display device 10, the virtual image M corresponding to the information image is viewed as moving within the displayable area E of the windshield 2*a*.

The virtual image M viewed by the occupant 3 on the far side of the windshield 2*a* has the trajectory image J showing the approaching of the rearward vehicle W approaches from the rear of the host vehicle 2 as illustrated in FIG. 2. The trajectory image J is a linear arrow image superposed on the lane adjacent to the lane on which the host vehicle 2 is traveling, and extending from a predetermined start point Jp on the near side of the occupant 3 to an end point Jq in a traveling direction. The trajectory image J is an image deformed in accordance with the shape (curves, ups and downs) of the adjacent lane, and is an image displayed in perspective to be viewed so that a width of a side closer to the host vehicle 2 is larger (relatively greater) and a width of a side distant from the host vehicle 2 is narrower (relatively smaller). Although the lane adjacent to the lane on which the host vehicle 2 is traveling herein is the lane parallel to the lane on which the host vehicle 2 is traveling, the lane adjacent to the lane on which the host vehicle 2 is traveling may also be an opposite lane on which the rearward vehicle W passing the host vehicle 2 is traveling. The end point Jq which is an end portion of the trajectory image J can indicate a relative position of the rearward vehicle W with respect to the host vehicle 2 after predetermined time (e.g., 20 seconds) elapses. For example, a relative position of the end point Jq indicated in the trajectory image J corresponds to a relative position of the rearward vehicle W that the occupant 3 views from the host vehicle 2 after 20 second elapses. The trajectory image J in the present invention is deformed into various display modes depending on the relationship between the rearward vehicle W and the host vehicle 2 (the relative speed V and the relative distance D). The deformation process of the trajectory image J will be described in detail later. Although the relative distance D indicates a distance between the rearward-information acquisition unit 204 mounted in the host vehicle 2 and a part of the rearward vehicle W closest to the rearward-information acquisition unit 204, this is not restrictive.

The information image other than the trajectory image J include, for example, images displayed in accordance with a specific object (e.g., a lane, a white line, a forward vehicle, and an obstacle) in the actual view outside the host vehicle 2, such as a guide route image in which a route to a destination is superposed on the lane outside the host vehicle 2 (the actual view) and conducts route guidance (not illustrated), and the white line is recognized by a later-described stereoscopic camera 201*a* when the host vehicle 2 is to deviate from the lane, a white line recognition image (not illustrated) which is superposed near the white line to make the user recognize the existence of the white line to suppress lane deviation, or which is simply superposed near the white line to make the user recognize the existence of the white line, or images which are not displayed in accordance with a specific object of the actual view outside the host vehicle 2, such as an operation condition image (not illustrated) regarding the operation condition of the host vehicle 2, such as speed information, number of rotation information, and fuel efficiency information, of the host vehicle 2.

The information acquisition unit 200 is provided with a forward information acquisition unit (a lane-information acquisition means) 201 which captures images in front of the host vehicle 2 and estimates the situation ahead of the host vehicle 2, a navigation system (a lane-information acquisition means) 202 which conducts a route guidance of the host vehicle 2, a GPS controller 203, and a rearward-information acquisition unit 204 (a rearward vehicle detection means, interruption estimation means). The information acquisition unit 200 outputs information acquired by each of these components to the later-described display controller 300. Although the lane-information acquisition means described in the claims of the present application are constituted by, for example, the forward information acquisition unit 201 and the navigation system 202 in the present embodiment, these are not restrictive if the situation of the lane around the host vehicle 2 can be estimated. The situation of the lane around the host vehicle 2 may be estimated by making communication between an external communication device, such as a millimeter wave radar and a sonar, or a vehicle information communication system, and the host vehicle 2. The rearward vehicle detection means and the interruption estimation means described in the claims of the present application are constituted by the rearward-information acquisition unit 204 in the present embodiment.

The forward information acquisition unit (the lane-information acquisition means) 201 acquires information in front of the host vehicle 2, and is provided with the stereoscopic camera 201*a* which captures images in front of the host vehicle 2, and a captured image analysis unit (not illustrated) which analyzes captured image data acquired by the stereoscopic camera 201*a* in the present embodiment.

The stereoscopic camera 201*a* captures the forward area including the road on which the host vehicle 2 is traveling. When the captured image analysis unit conducts image analysis of the captured image data acquired by the stereoscopic camera 201*a* by pattern matching, information about the road geometry (e.g., a lane, a white line, a stop line, a pedestrian crossing, a road width, the number of lanes, a crossing, a curve, and a branch), and existence of an object on the road (a forward vehicle and an obstacle) are analyzable. Further, a distance between the specific object (e.g., a white line, a stop line, a crossing, a curve, a branch, a forward vehicle, and an obstacle) and the host vehicle 2 is calculable by image analysis based on the principle of triangulation.

That is, in the present embodiment, the forward information acquisition unit 201 outputs, to the display controller 300, the information about the road geometry analyzed from the captured image data captured by the stereoscopic camera 201*a*, the information about the object on the road, and the information about the distance between the captured specific object and the host vehicle 2.

The navigation system (the lane-information acquisition means) 202 is provided with a storage which stores map data including information about road (e.g., the road width, the number of lanes, a crossing, a curve, and a branch), reads map data near the current position from the storage based on position information from the GPS controller 203, and outputs information about the road near the current position to the display controller 300.

The GPS (Global Positioning System) controller 203 receives GPS signals from, for example, artificial satellites, calculates the position of the host vehicle 2 based on the GPS signals, and outputs the calculated position of the host vehicle to the navigation system 202.

The rearward-information acquisition unit (the rearward vehicle detection means, interruption estimation means) 204 is a distance measurement sensor which measures a distance (the relative distance D) between the host vehicle 2 and the rearward vehicle W located on the back or on the side of the host vehicle 2 (the rearward vehicle) and is configured by, for example, a distance measurement camera or a radar sensor. The rearward-information acquisition unit 204 can independently recognize a plurality of rearward vehicles W approaching the host vehicle 2, can continuously or intermittently detect a distance between the host vehicle 2 and each rearward vehicle W, and can calculate the relative speed of each rearward vehicle W based on the speed of the host vehicle 2 by comparing time differences and the like. That is, the rearward-information acquisition unit 204 outputs, to the later-described display controller 300, the relative distance D and the relative speed V of each rearward vehicle W approaching the host vehicle 2. Alternatively, the rearward-information acquisition unit 204 may be provided with a communication means, such as car-to-car communication or road-to-vehicle communication through a communication infrastructure on the road, and may obtain the relative distance D and the relative speed V based on the mutual vehicle positions and time differences therebetween.

The display controller 300 is an ECU (Electrical Control Unit) consisting of a CPU, a ROM, a RAM, a graphic controller, and the like. The display controller 300 is provided with a ROM 301 which stores image data to be supplied to the HUD device 100, later-described table data, programs for executing processes, and the like, an information image generation means 302 which reads image data from the ROM 301 based on the information input from the vehicle outside information acquisition unit 200 and generates drawing data, and a display control means 303 which controls display of the display device 10 of the HUD device 100.

The information image generation means 302 reads image data from the image memory based on the information input from the information acquisition unit 200, generates information image to be displayed on the display device 10, and outputs the generated image to the display control means 303.

In generation of the information image, the information image generation means 302 determines a display form and a position to display the trajectory image J based on the information about the road geometry input from the forward information acquisition unit 201 and the navigation system 202, and generates the drawing data of the information image so that the virtual image M showing the trajectory image J is viewed at the position corresponding to the lane adjacent to the lane on which the host vehicle 2 is traveling.

The information image generation means 302 changes the display modes of the trajectory image J depending on the relative distance D and/or the relative speed V. In particular, the information image generation means 302 changes a separation distance Fq from the host vehicle 2 to a specific position in the outside scenery indicated by the end point Jq in the trajectory image J, and changes an extension speed which is a speed at which the trajectory image J extends from the start point Jp to the specific end point Jq depending on the relative distance D and the relative speed V.

Hereinafter, a conversion process of the display of the trajectory image J executed by the information image generation means 302 will be described with reference to FIGS. 3 to 7. FIGS. 3 and 4 are diagrams of the host vehicle 2 and the rearward vehicle W traveling on the lanes seen from above. FIG. 3 is a diagram illustrating a state that the separation distance Fq of the trajectory image J changes depending on the change of the relative distance D, and FIG. 4 is a diagram illustrating a state that the separation distance Fq of the trajectory image J changes depending on the change of the relative speed V. FIG. 5 is a diagram illustrating a sight when the occupant 3 views in front thereof, and is a diagram for describing extension of the trajectory image J. FIG. 6 is a diagram illustrating table data for determining an extension speed of the trajectory image J. FIG. 7 is a timing chart illustrating changes in the separation distance Fq by the relative speed V and the relative distance D. Here, regarding the relative distance D, for example, 10 m or less is defined as a short distance, 10 m to 20 m is defined as a middle distance, and 30 m or longer is defined as a long distance. Regarding the relative speed V, 10 km/h or lower is defined as a low speed, 10 to 30 km/h is defined as a middle speed, and 30 km/h or higher is defined as a high speed.

With reference to FIG. 3, the change in the separation distance Fq according to the change in the relative distance D will be described. The information image generation means 302 inputs the relative distance D which is the distance between the host vehicle 2 and the rearward vehicle W from the rearward-information acquisition unit 204, generates a trajectory image Ja with a shorter separation distance Fq (Fq=Fa) and if the relative distance D is large (D=Da), and generates a trajectory image Jb with a longer separation distance Fq (Fq=Fb>Fa) if the relative distance D is small (D=Db<Da). The separation distance Fq is changed to be linear depending on the change in the relative distance D. When the rearward vehicle W is separated by a predetermined distance or longer on the rear of the host vehicle 2, the trajectory image J is not displayed (the separation distance Fq=0) and, also when the rearward vehicle W is separated by a predetermined distance or longer ahead of the host vehicle 2, the trajectory image J is not displayed (the separation distance Fq=0). With this configuration, based on the length (the separation distance Fq) of the trajectory image J, the occupant 3 can estimate the relative distance D between the host vehicle 2 and the rearward vehicle W located on the back or on the side of the host vehicle 2, and can accurately determine the approaching state of the rearward vehicle W.

With reference to FIG. 4, the change in the separation distance Fq according to the change in the relative speed V will be described. The information image generation means 302 inputs the relative speed V of the host vehicle 2 and the rearward vehicle W from the rearward-information acquisition unit 204, generates a trajectory image Ja with a shorter separation distance Fq (Fq=Fa) and if the relative speed V is low (V=Va), and generates a trajectory image Jb with a longer separation distance Fq (Fq=Fb>Fa) if the relative speed V is high (V=Vb>Va). The separation distance Fq changes depending on the gradual change in the relative speed V. With this configuration, based on the length (the separation distance Fq) of the trajectory image J, the occupant 3 can estimate the relative speed V between the host vehicle 2 and the rearward vehicle W, and can accurately determine the approaching state of the rearward vehicle W.

Next, a state that the trajectory image J extends will be described with reference to FIG. 5. When the relative distance D input from the vehicle outside information acquisition unit 200 becomes shorter than a predetermined distance, the display controller 300 executes an initial display in which the trajectory image J is displayed in an extended manner. The initial display is a display in which the trajectory image J is dynamically extended from the start point Jp to the end point Jq to provide a target length (the separation distance Fq) and, in particular, is a display which extends gradually as F1 (FIG. 5(*a*)), F2 (FIG. 5(*b*)), and F3 (FIG. 5(*c*)) until the separation distance F reaches the target separation distance Fq. As described above, the occupant 3 can reliably know the approaching of the rearward vehicle W by the dynamic initial display in front of the occupant 3. The extension speed in the initial display is determined by the relative distance D and the relative speed V of the rearward vehicle W at the time of starting of the initial display. In particular, the ROM 301 stores in advance table data of the extension speed (the extension speed $\alpha$, the extension speed $\beta$, and the extension speed $\gamma$) in association with two-dimensional data of the relative distance D and the relative speed V as illustrated in FIG. 6, the extension speed corresponding to the relative distance D and the relative speed V input from the rearward-information acquisition unit 204 is determined based on the table data. It is set that the extension speed becomes higher as the relative speed V is higher (the extension speed $\alpha>\beta>\gamma$), and the extension speed becomes higher as the relative distance D is shorter.

With reference to FIG. 7, a transition in the separation distance Fq of the trajectory image J based on the relative distance D and the relative speed V will be described. FIG. 7(*a*) illustrates a transition in the relative speed V, FIG. 7(*b*) illustrates a transition in the relative distance D, FIG. 7(*c*) illustrates a transition in the separation distance Fq based on the relative speed V, FIG. 7(*d*) illustrates a transition in the relative distance D and the separation distance Fq of the trajectory image J based on the relative speed V. First, until time t1, since the relative distance D is larger than a threshold Dmin, it is determined that the rearward vehicle W is not sufficiently approaching the host vehicle 2, and the trajectory image J is not displayed (the separation distance Fq=0). At time t1, when the relative distance D reaches a threshold Dmin, the initial display in which the separation distance Fq of the trajectory image J increases gradually until it reaches the target separation distance Fq is conducted before a predetermined time (e.g., 3 seconds) elapses (conducted until the time t2). The extension speed at this time is determined based on the table data of the relative distance D and the relative speed V, and the target separation distance Fq is determined by the relative speed V at time t1. After the initial display is completed, the separation distance Fq is increased or decreased depending on the change in the relative speed V and the relative distance D. Since the rearward vehicle W gradually approaches the host vehicle 2 between time t2 and t3, the relative distance D becomes shorter gradually and, based thereon, the separation distance Fq also increases linearly. The separation distance Fq is increased only when the relative speed V elongates is changed by a predetermined value. For example, the separation distance Fq is not changed even if the relative speed V is lowered between time t3 and time t4, and the separation distance Fq is changed when the relative speed V reaches a predetermined value (V2) between time t4 and time t5. When the separation distance Fq is changed by the relative speed V, the separation distance Fq is changed rapidly until a predetermined time (e.g., 1 second) elapses. Further, when the rearward vehicle W travels in front of the host vehicle 2 and the relative distance D reaches a threshold Dmax (time t6), the trajectory image J is not displayed (the separation distance Fq=0). Hereinafter, an example of a process executed by the display controller 300 regarding the display of the trajectory image J will be described with reference to the flow diagram of FIG. 8.

With reference to FIG. 8, first in step S10, the display controller 300 inputs the relative distance D and the relative speed V from the rearward-information acquisition unit 204 and determines whether the rearward vehicle W is approaching (step S20). If the rearward vehicle W is approaching, in step S30, the display controller 300 determines whether the relative distance D is within the threshold Dmin. If the relative distance D is within the threshold Dmin (step S30: YES), the display controller 300 determines the separation distance Fq and the extension speed for displaying the trajectory image J as the initial display based on the input relative distance D and the input relative speed V (step S40), and executes the initial display (step S50). Then, the display controller 300 displays (updates) the trajectory image J based on the relative distance D and the relative speed V of the rearward vehicle W. Processes after step S60 are described with reference to the flow diagram of FIG. 9.

With reference to FIG. 9, in step S62, the display controller 300 inputs the relative distance D and the relative speed V from the rearward-information acquisition unit 204, determines the separation distance Fq for determining the position to be indicated by the end point Jq of the trajectory image J based on these relative distance D and relative speed V (step S63), and updates and displays the trajectory image J in accordance with the separation distance Fq (step S64). Further, in step S65, the display controller 300 determines whether it is possible that the rearward vehicle W interrupts the host vehicle 2. In particular, when flashing of a blinker of the rearward vehicle W is recognized by a side camera provided in the host vehicle 2, or when continuous approaching in transverse displacement of the rearward vehicle W is detected by the distance measurement sensor provided in the host vehicle 2, the display controller 300 determines that it is possible that the rearward vehicle W interrupts the host vehicle 2. If the display controller 300 determines that it is possible that the rearward vehicle W interrupts the host vehicle 2 (step S65: YES), the display controller 300 calculates a positional relationship between the host vehicle 2 and the rearward vehicle W in a virtual two-dimensional (or three-dimensional) space based on the information from the distance measurement sensor or the side camera, and estimates the traveling direction of the rearward vehicle W in the virtual space (step S66). Then, based on the estimated traveling direction of the rearward vehicle W, the trajectory image J is deformed into an interruption trajectory image H having an arrow shape interrupting the host vehicle 2, and is displayed (step S67).

In step S67, the interruption trajectory image H is gradually deformed to become a desired shape of the interruption trajectory image H from the trajectory image J as illustrated in FIG. 10. A deformation speed at this time is determined from the relative distance D and the relative speed V based on the table data of a deformation speed associated with the two-dimensional data of the relative distance D and the relative speed V as illustrated in FIG. 6. Specifically, for example, the deformation speed $\alpha$ is 15°/sec, the deformation speed $\beta$ is 5°/sec and the deformation speed $\gamma$ is 2.5°/sec.

Then, in step S37, the display controller 300 displays the trajectory image J and the interruption trajectory image H in different colors so that the occupant 3 can clearly recognize that the trajectory image J has been deformed into the interruption trajectory image H. As the display color, for example, the trajectory image J is displayed in green which gives feeling different from the caution or warning to indicate the existence of the rearward vehicle W. The interruption trajectory image H is displayed in yellow or red which means caution or warning that a possibility of contact is increasing with the rearward vehicle W actually interrupting the host vehicle 2.

Further, in step S37, when the trajectory image J is deformed into the interruption trajectory image H, the display controller 300 makes at least one of the trajectory image J or the interruption trajectory image H blink. For example, the trajectory image J is made to blink when image deformation is executed and then the trajectory image J is deformed into the interruption trajectory image H. In this manner, the occupant 3 can be easily informed of the change in the display mode of the trajectory image J. Conversely, only the interruption trajectory image H may be made to blink or both the trajectory image J and the interruption trajectory image H may be made to blink. A blinking cycle is determined not to cause unnecessary gaze and attention guidance even if the display is superposed on the front vision.

As described above, according to the vehicle information projection system 1 in the present embodiment, since approaching of the rearward vehicle W from the rear can be detected by the rearward-information acquisition unit 204 and the trajectory image J can be displayed in a superposed manner on the next lane on which the host vehicle 2 is traveling, it is possible to make the occupant 3 recognize in advance the lane on which the rearward vehicle W is traveling while the occupant 3 is viewing ahead, and make the occupant 3 pay attention to the target lane.

Further, since the end point Jq of the trajectory image J can be displayed while gradually moving in a traveling direction of the lane on which the rearward vehicle W is traveling, the user can be informed of the approaching of the rearward vehicle W more urgently with a dynamic change in the image, and the user can be made to recognize intuitively that the rearward vehicle W is passing on target lane.

Further, since the moving speed (the extension speed) of the end point Jq of the trajectory image J can be changed depending on the relative distance D and/or the relative speed V, the user can be made to recognize intuitively the danger by the relative distance D and the relative speed V of the rearward vehicle W due to a difference in the extension speed in the trajectory image J in a short time. Further, by changing smoothly the position of the end point Jq of the trajectory image J (the extension speed: low) based on the change in the relative distance D, and by changing stepwise and rapidly the position of the end point Jq of the trajectory image J (the extension speed: high) based on the change in the relative speed V by a predetermined value, the occupant 3 can be made to recognize which of the relative distance D and the relative speed V has been changed due to the change in the extension speed. In order to produce the same effect, based on the change in the relative distance D or the relative speed V, a display mode, such as color, luminance, shape, and the like, of the trajectory image J when the trajectory image J extends may be changed. As an alternative method for increasing the extension speed, timing at which the trajectory image J extends may be delayed with respect to the change in the relative speed V (the relative distance D), and the position of the end point Jq of the trajectory image J may be rapidly changed after predetermined time elapses from the change of the relative speed V (the relative distance D).

Further, since the length of the trajectory image J (the separation distance Fq from the host vehicle 2 to the position indicated by the end point Jq of the trajectory image J) can be changed depending on the relative distance D and/or the relative speed V, the user can be made to recognize intuitively the danger by the relative distance D and the relative speed V of the rearward vehicle W due to a difference in the length in the trajectory image J in a short time.

Further, when interruption by the rearward vehicle W is estimated by the rearward-information acquisition unit (the interruption estimation means) 204, the display controller 300 can make the interruption trajectory image H which has been deformed from the trajectory image J so that at least the end point Jq enters the lane on which the host vehicle 2 is traveling to be displayed, and can make the user to recognize in advance that the rearward vehicle W is interrupting the host vehicle 2.

The present invention is not limited by the above-described embodiment and the drawings. Modification (including deletion of components) can be made suitably without changing the scope of the present invention. Hereinafter, an example of a modification will be described.

In the above-described embodiment, the trajectory image J is described as an image which extends from the start point Jp and forms an arrow shape at the end point Jq thereof, but the shape of the trajectory image J is not limited to the same and can be modified. For example, the end point Jq does not necessarily have to be an arrow shape but may be a line segment extending from the start point Jp to the end point Jq, and the portion connecting the start point Jp and the end point Jq may be depicted by a dashed line or a dotted line. Further, instead of using an image extending from the start point Jp to the end point Jq, a specific fixed image may be moved at a determined moving speed to a determined separation distance Fq depending on the separation distance Fq and the moving speed (the extension speed in the above-described embodiment) determined as in the above-described embodiment.

In the above-described embodiment, when the relative distance D input from the vehicle outside information acquisition unit 200 becomes less than a predetermined distance, the initial display in which the trajectory image J is displayed in an extended manner and is displayed, but a trigger of the initial display is not limited to the same. The display controller 300 may determine whether the occupant 3 has an intention of changing lanes by the existence of the operation of a directional light (a lane change estimation means) of the host vehicle 2 which is not illustrated and, if there is an operation of the directional light by the occupant 3, the initial display of the trajectory image J may be executed. With this configuration, if there is a rearward vehicle W approaching the lane to which the host vehicle 2 is to change lanes (the lane adjacent to the lane on which the host vehicle 2 is traveling), the user can be warned promptly by the initial display in which the end point Jq of the trajectory image J is moving. As an alternative trigger for the start of displaying the initial display, an unillustrated gaze detection means (a lane change estimation means) which detects the gaze of the occupant 3 and, when the occupant 3 gazes at a rearview mirror of the host vehicle 2, the gaze detection means may determine that the occupant 3 has an intention of changing lanes, and may start displaying the initial display at that time. Further, when the host vehicle 2 travels excessively close to the adjacent lane, the initial display may be started by, for example, a detection signal from the forward information acquisition unit 201.

In the above-described embodiment, the extension speed (the change speed) at which the end portion (the end point Jq) of the trajectory image J moves is determined by the table data of the relative distance D and the relative speed V, but these extension speeds (the change speed) may be determined by calculation, such as aD+bV (a and b are coefficients).

INDUSTRIAL APPLICABILITY

The vehicle information projection system of the present invention is applicable as a head-up display which is mounted on a movable body, such as a vehicle, and makes a user view a virtual image.

DESCRIPTION OF REFERENCE NUMERALS

1 vehicle information projection system
2 host vehicle
3 occupant (user)
100 head-up display device (HUD device, projection device)
200 information acquisition unit
201 forward information acquisition unit (lane-information acquisition means)
201*a* stereoscopic camera
202 navigation system (lane-information acquisition means)
203 GPS controller
204 rearward-information acquisition unit (rearward vehicle detection means, interruption estimation means)
300 display controller
D relative distance
Fq separation distance
H interruption trajectory image (interruption-indicating image)
J trajectory image (approach-indicating image)
Jp start point
Jq end point (end portion)
K image light
L display light
M virtual image
V relative speed
W rearward vehicle

The invention claimed is:

1. A vehicle information projection system, with a projection device configured to project an information image on a front windshield of a host vehicle, and a lane-information acquisition means configured to acquire lane information, and enabling a user to view an image showing the information image with an actual view outside the host vehicle, the system comprising:

a rearward vehicle detection means configured to detect a relative distance and a relative speed between the host vehicle and the rearward vehicle; and a display controller configured to control the projection device so as to superpose an approach-indicating image on the front windshield which indicates approaching of the rearward vehicle in a lane adjacent to that on which the host vehicle is traveling when approaching of the rearward vehicle is detected by the rearward vehicle detection means, wherein when the detected relative distance becomes shorter than a predetermined distance, the display controller is configured to execute an initial display where a separation distance, by which the superposed approach-indicating image appears to extend in front of the host vehicle, increases up to a target separation distance, and after the initial display is completed, the separation distance increases or decreases based on changes in the detected relative speed and the detected relative distance.

2. The vehicle information projection system according to claim 1, further comprising an interruption estimation means configured to estimate that the rearward vehicle interrupts the host vehicle, wherein, when interruption of the rearward vehicle is estimated by the interruption estimation means, the display controller makes an interruption-indicating image which has been deformed from the approach-indicating image so that at least an end portion enters the lane on which the host vehicle is traveling be displayed.

3. The vehicle information projection system according to claim 2, wherein the display controller is capable of changing a deformation speed from the approach-indicating image to the interruption-indicating image depending on the relative distance and/or the relative speed.

* * * * *